United States Patent [19]

Brandt

[11] 4,202,469

[45] May 13, 1980

[54] BLADE HOLDER AND NOZZLE ASSEMBLY

[76] Inventor: Michael W. Brandt, 1604 Park Blvd., Plano, Tex. 75074

[21] Appl. No.: 908,161

[22] Filed: May 22, 1978

[51] Int. Cl.[2] ..... B67B 7/26

[52] U.S. Cl. ..... 222/91

[58] Field of Search ..... 222/81, 83, 83.5, 82, 222/91, 80, 88; 30/401, 407, 445, 130

[56] References Cited

U.S. PATENT DOCUMENTS

| | | | |
|---|---|---|---|
| 1,992,320 | 2/1935 | Maggenti | 222/91 |
| 3,402,855 | 9/1968 | Schroeder et al. | 222/83 |
| 3,613,955 | 10/1971 | Wetherell et al. | 222/91 X |

*Primary Examiner*—Stanley H. Tollberg
*Attorney, Agent, or Firm*—Gerald G. Crutsinger; John F. Booth; Harry C. Post III

[57] ABSTRACT

A blade holder and nozzle assembly connectable to a flexible container closure element such that when the blade holder and nozzle assembly is connected to the flexible closure a circular opening is formed in the flexible closure and surfaces on the blade holder and nozzle assembly and on the flexible closure are urged into sealing relation. The assembly comprises a hollow, tubular body having a shoulder extending around the interior thereof dividing the interior of the body into a threaded bore in the lower end of the body and a nozzle in the upper end of the body. A single cutting blade having a pointed end and a single cutting edge is secured to the shoulder and extends into the threaded bore such that as the body is threadedly secured to a flexible closure element, the cutting blade pierces the upper surface of the closure element and as the body is rotated the blade cuts a circular opening in the upper end of the closure element. The shoulder in the body moves into sealing engagement with the closure element about the periphery of the circular opening formed therein. Liquid from a container can be poured through the opening formed in the closure element and dispensed through the nozzle.

5 Claims, 6 Drawing Figures

BLADE HOLDER AND NOZZLE ASSEMBLY

BACKGROUND

The apparatus disclosed herein relates to improvements in a threaded blade holder of the type disclosed and claimed in U.S. Pat. No. 4,074,426, issued Feb. 21, 1978, to Michael W. Brandt. The disclosure of U.S. Pat. No. 4,074,426 is incorporated herein by reference in its entirety for all purposes.

Liquid material, such as lubricating oil, cleaners, wax, printing ink, pesticides and other chemicals are sometimes packaged and stored in pails constructed of metal, plastic, or fiber. Such pails are often equipped with a flexible closure element of the type distributed under the trademark "Flexspout" manufactured by Rieke Corporation of Auburn, Indiana. These flexible closures afford a directional pour spout which is collapsible for easy stacking of the pails and which can be sealed by a threaded cap after opening.

These flexible closure elements come sealed from the factory and the diaphragm must be removed from the outer end of the closure element or spout for dispensing liquid materials contained in the pail. The threaded blade holder disclosed in my patent referred to above was devised for removing these closure elements.

The blade holder and nozzle assembly disclosed herein incorporates a portion of the structure disclosed in my aforementioned patent in combination with an improved body construction which permits pouring liquid through the blade holder and nozzle assembly directly from the container.

Devices heretofore devised to open a membrane—sealed plastic container are disclosed in the following U.S. Pat. Nos. 3,402,855; 3,581,605; 3,784,045; and 4,074,426.

SUMMARY OF INVENTION

I have devised a threaded blade holder and nozzle assembly for cutting a smooth edged circular opening through the upper diaphragm surface of a flexible closure element or pour spout on a pail or container. The device comprises a hollow tubular body having a shoulder formed therein through which a central aperture extends to permit flow of liquid into a nozzle formed on the upper end of the tubular body.

A narrow, thin, flat blade, having a single sharpened cutting edge, extends downwardly from the shoulder in the body such that the blade engages the upper surface of the closure element at a single point after threads on the body of the blade holder and nozzle assembly have engaged the threads on the outer surface of the closure element.

As the body of the blade holder is further rotated, the blade travels in a circular path cutting through the surface of the closure element to cut a circular opening in the closure element.

Either the passage bounded by the shoulder in the tubular body, which functions as an inlet passage to the nozzle, or the opening formed in the outer end of the nozzle, which forms an outlet passage from the nozzle, is smaller in diameter than the diameter of the circular opening formed in the closure element. Thus, the circular portion of the diaphragm which is cut from the end of the closure element will at all times be retained in the container and will not pass through the nozzle.

A primary object of the invention is to provide a threaded blade holder and nozzle assembly which is adapted to form a uniform, smooth, non-drip edge on the upper surface of a flexible pour spout or closure element such that a shoulder in the assembly is capable of sealing against the upper end of the spout to permit pouring of liquid from the container through the assembly.

Another object of the invention is to provide a blade holder and nozzle assembly having a blade mounted therein, the blade having a cutting edge only on the leading edge thereof to prevent cutting and roughening surfaces adjacent the periphery of an aperture in a closure element upon removal of the blade holder and nozzle assembly from the closure element.

Other and further objects of the invention will become apparent upon referring to the detailed description hereinafter following and to the drawings annexed hereto.

DESCRIPTION OF DRAWING

Drawings of a preferred embodiment of the invention are annexed hereto so that the invention may be better and more fully understood, in which.

Numeral references are employed to designate like parts throughout the various figures of the drawings.

DESCRIPTION OF A PREFERRED EMBODIMENT

Figure 1:
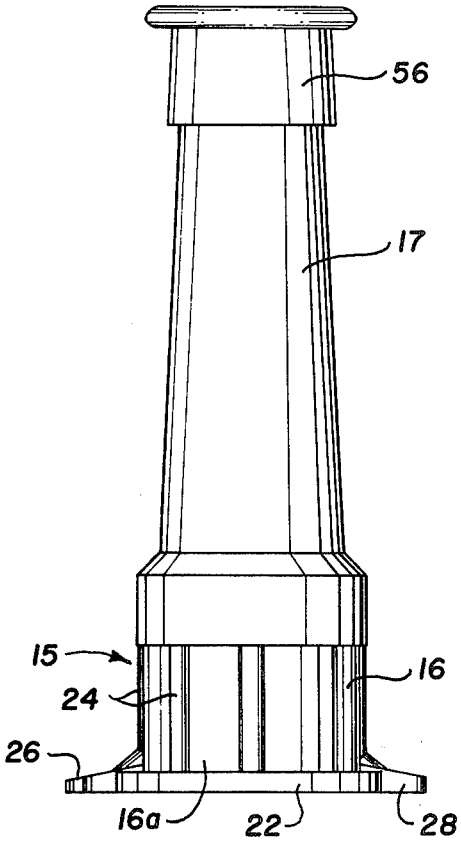
FIG. 1 is a front elevational view of the blade holder and nozzle assembly.
Figure 2:
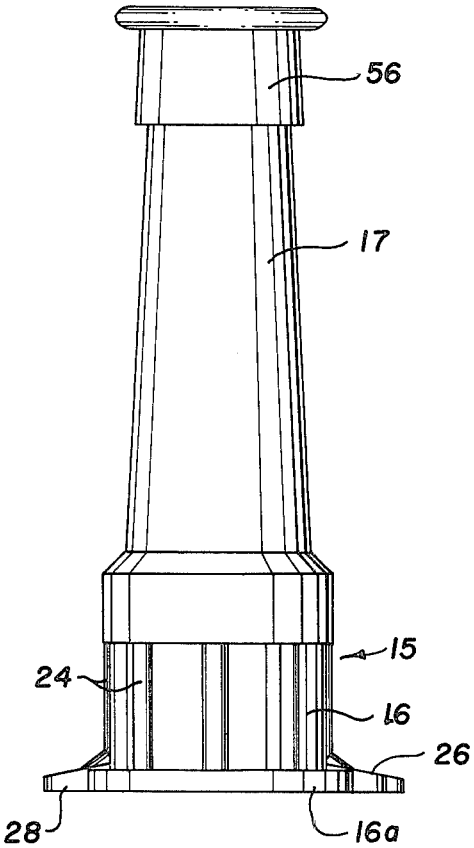
FIG. 2 is a side elevational view thereof.

Referring to FIGS. 1-6 of the drawing, numeral 15 generally designates a blade holder and nozzle assembly comprising a hollow tubular body 16 having a nozzle 17 formed on the upper end thereof, a threaded bore 18 formed in the lower end thereof, and a shoulder 20 separating the nozzle 17 and the threaded bore 18.

An annular flange 22 extends about the lower end **16*a* of body 16 to provide structural rigidity and to facilitate gripping and rotating the hollow tubular body 16. The exterior surface of the hollow tubular body 16 has gripping lugs or ridges 24 formed thereon to roughen the exterior surface of body 16 to aid in attaching the body 16 to a flexible pour spout 65**, as will be hereinafter more fully explained.

The hollow tubular body 16 may be injection molded in one or more pieces and secured together to form a single unit of rigid material, such as hard plastic or metal.

Tapered pry-bars 26 and 28 extend outwardly from opposite sides of annular flange 22 on the lower end **16*a* of body 16 to provide a hand bar for prying off seals or temporary covers which are generally placed over collapsible pour spouts 65**, as will be hereinafter more fully explained.

Figure 3:
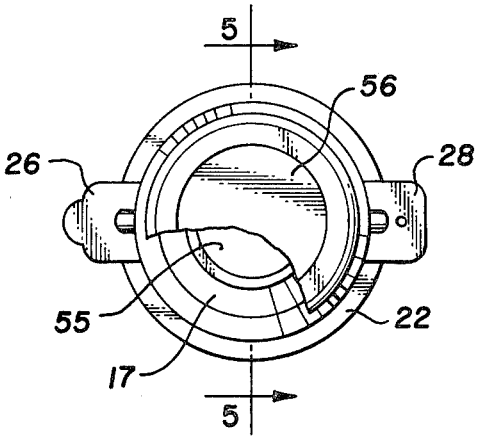
FIG. 3 is a top plan view thereof.
Figure 4:
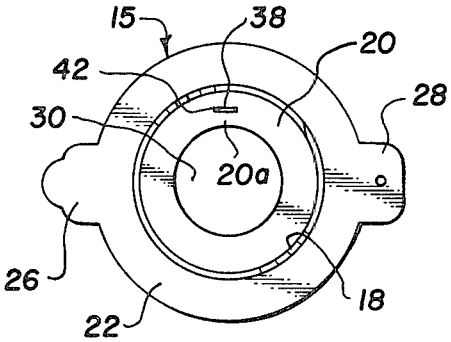
FIG. 4 is a bottom view thereof.
Figure 5:
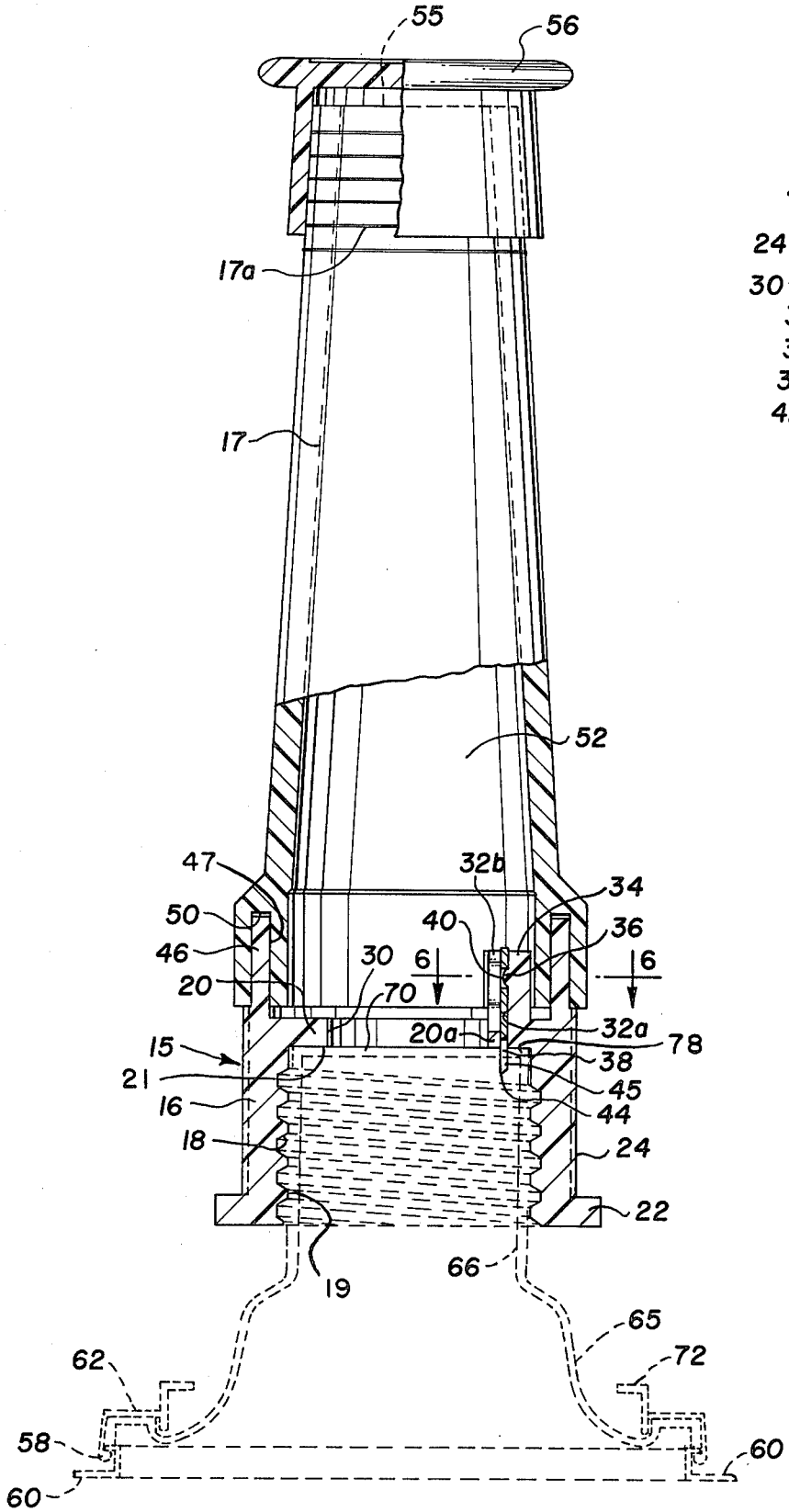
FIG. 5 is a cross-sectional view taken along line 5—5 of FIG. 3.
Figure 6:
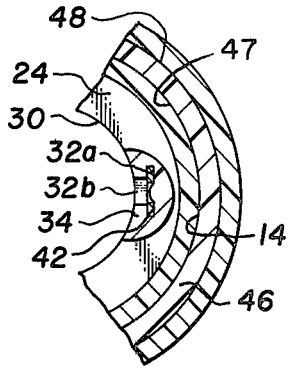
FIG. 6 is a cross-sectional view taken along line 6—6 of FIG. 5.

The shoulder 20, extending perpendicular to the central axis of hollow tubular body 16, extends about the periphery of a central passage 30. As best illustrated in FIGS. 3 and 5 of the drawing, a circular plug 34 extends upwardly from the upper surface of shoulder 20 and has a socket 32 formed therein. Socket 32 is preferably T-shaped and comprises intersecting legs or elongated slots 32*a* and 32*b*. The lower end of slot 32*a* extends through the shoulder 20 and communicates with threaded bore 18. Slot 32*b* preferably terminates adjacent the upper surface of shoulder 20 such that portion 20*a* of shoulder 20 forms a closure across the lower end of slot 32*b*.

As will be hereinafter more fully explained, the T-shaped configuration of socket 32 causes the central portion of blade 38 to flex slightly to facilitate insertion of the blade.

The elongated portion or slot 32*a* of opening 32 extends perpendicular to the radius of the body 16 and is radially inwardly from the inner wall 19 of threaded bore 18.

A detent 36 extends into the elongated portion or slot 32*a* of socket 32 from a central portion of the outer wall 32*c* of the elongated portion 32*a* of socket 32.

The cutting blade 38 has an aperture 40 formed therein. As blade 38 is urged downwardly through the elongated portion 32*a* of socket 32, the detent 36 on the outer wall 32*c* urges the central portion of blade 38 into the elongated portion 32*a* of socket 32. When detent 36 and aperture 40 become aligned, blade 38 returns to a flat configuration and is detachably secured in the elongated portion 32*a* of socket 32.

The blade 38 comprises a thin, narrow metallic member having a cutting edge 42 extending vertically along one side and having a lower end on the opposite side cut away to form a point 44. It should be appreciated that point 44 is formed by tapered edge 45 which is not sharpened.

It should be readily apparent that the point 44 on blade 38, when detent 36 is positioned in aperture 40, extends downwardly through the elongated portion 32*a* of socket 32 and that the cutting edge 42 is arranged to cut through the upper diaphragm portion 70 closing the upper end of pour spout 65.

As best illustrated in FIG. 5 of the drawing, a round cylindrical projection 46 having an inner wall 47 and an outer wall 48 extends upwardly from the upper surface of shoulder 20. The nozzle portion 17 of tubular body 16 has an annular slot 50 formed in the lower end thereof. The annular projection 46 extends into slot 50 for connecting the nozzle portion 17 thereto.

The nozzle portion 17 has an upwardly converging flow passage 52 formed therein, the upper end 55 being open to form a discharge opening from nozzle 17. The passage 30 formed in shoulder 20 forms an entrance passage into the flow passage 52 in nozzle 17.

Either the passage 30 bounded by the shoulder 20 in the hollow tubular body 16, which functions as an inlet passage to the nozzle 17, or the opening 55 in the outer end of nozzle 17, which forms an outlet passage from the nozzle, is smaller in diameter than the diameter of the circular opening formed in the end 70 of closure element 65. Thus, the circular portion of the diaphragm which is cut from the end of the closure element by blade 38 will at all times be retained in the container and will not pass through flow passage 52.

A conventional flexible pour spout closure 65 is illustrated in dashed outline in FIG. 5. The pour spout 65 is of the type manufactured by Rieke Corporation of Auburn, Indiana, and sold under the trademark "Flexspout".

Spout 65 is adapted to fit over flange 58 which is formed about an opening 59 in the top or upper surface of pail or container 60, as illustrated in dashed outline.

OPERATION

The operation and function of the blade holder and nozzle assembly hereinbefore described is as follows:

Referring to FIG. 5 of the drawing, pour spout 65, illustrated in dashed outline, is initially collapsed into the container 60 such that the upper end 70 is at an elevation substantially equal to that of the upper surface of the annular retaining ring 62 and a circular seal or closure member 72 is secured to retaining ring 62 completely concealing pour spout 65.

Pry-bar 26 on the lower end of the hollow tubular body 16 is employed for removing seal member 72 from annular retaining ring 62. The flexible spout 65 is then pulled upwardly to the position shown in dashed outline in FIG. 5 of the drawing.

Such spouts are generally provided a cap threadedly secured to the upper end of the spout 65. The cap (not shown) is removed from spout 65.

Hollow tubular body 16 is then positioned on the externally threaded upper end 68 of flexible spout 65 and is rotated to start body 16 onto the threads on the spout.

The body 16 is then further rotated to move the body downwardly on spout 65 until the point 44 on blade 38 engages the upper surface of sealing membrane 70. Blade 38, being positioned perpendicular to the radius of the threaded bore 18, forms a circular opening since blade 38 moves along a circular path as the hollow tubular body 16 moves downwardly onto the spout 65.

It should be appreciated that if container 60 is internally pressurized, the pressure is relieved through the opening formed by the pointed end 44 of blade 38. Any pressurized vapor escaping from container 60 will be deflected downwardly through space between the inner wall 19 of the threaded bore 18 and the outer surface of spout 65 and consequently in a direction generally away from the user of the blade holder and nozzle assembly or the vapor will be dissipated into the passage 52 in nozzle 17.

If the blade holder and nozzle assembly 15 is to be removed from the pour spout 65, this is accomplished by rotating the hollow tubular body 16 in a counterclockwise direction. It is important to note that since blade 38 has a sharpened cutting edge only on the leading edge 42, the blade will not cut or roughen the periphery of the opening formed in membrane 70 as the blade holder and nozzle assembly 15 is disconnected from the upper end of pour spout 65.

It should also be noted that since blade 38 is spaced radially inwardly from the upper wall 66 of spout 65, a flat upwardly extending annular shoulder 78 extends about the periphery of the opening formed in the diaphragm 70 on the end of pour spout 65. When the blade holder and nozzle assembly 15 is screwed onto pour spout 65 the flat inwardly extending annular shoulder 78 on pour spout 65 is urged into sealing engagement with the flat lower surface 21 on shoulder 20 at the upper end of threaded bore 18 in the assembly 15. Thus, liquid can be poured from container 60, through the opening formed in the upper end of the membrane 70, through passage 30, through flow passage 52 and dispensed through the outlet opening 55 in the end of nozzle 17.

In view of the fact that the pour spout 65 is often constructed of a very soft, flexible or pliable material, it is important that the point 44 on the end of blade 38 be very sharp such that it will penetrate diaphragm 70 upon application of a relatively small force to prevent stripping threads from the outer surface of spout 65. It is also important that only one blade 38 be provided in the blade holder and nozzle assembly 15 to maximize the penetrating pressure exerted on diaphragm 70.

The tapered rear edge 45 on blade 38 is preferably inclined at an angle of approximately 34 degrees and substantially intersects the flat lower surface 21 on shoulder 20 such that the blade does not roughen the smooth surface formed by the sharp cutting edge 42 and to minimize the probability that any burrs which might be present about the periphery of the opening formed in the diaphragm 70 will be removed to drop into container 60.

In view of the foregoing, it should be readily apparent that the apparatus hereinbefore described accomplishes the objects of the invention.

Having described my invention, I claim:

1. A Blade holder and nozzle assembly connectable to a flexible container spout closure element such that when the blade holder and nozzle assembly is connected to the flexible closure a circular opening is formed in the flexible closure and surfaces on the blade holder and nozzle assembly and on the flexible closure are urged into sealing relation, the assembly comprising: a hollow tubular body having a nozzle portion and a body portion, said body portion having an internally threaded bore in one end thereof; a shoulder inside said hollow tubular body portion intermediate opposite ends thereof, said shoulder having a central passage formed therein and having an elongated opening extending therethrough, said elongated opening being spaced outwardly from a central axis of said bore; a single, thin flat cutting blade having a pointed end and a single cutting edge; means to secure said cutting blade in said elongated opening such that as the body is threadedly secured to the spout, the cutting blade pierces the upper surface of the spout and as the body is rotated the blade cuts a circular opening in the upper end of the spout and such that the upper end of the spout adjacent the periphery of the circular opening is urged into sealing engagement with said shoulder; and a hollow cylindrical projection extending from said shoulder; said nozzle portion of said tubular body having an annular slot into which said cylindrical projection extends to secure said body portion and said nozzle portion together, said shoulder separating said nozzle from said threaded bore.

2. A blade holder and nozzle assembly according to claim 1, said elongated opening in said shoulder being spaced outwardly a greater radial distance from a central axis of the tubular body than the periphery of the passage formed in the shoulder to assure that the portion of the flexible closure which becomes detached when the circular opening is formed will not pass through said passage.

3. A blade holder and nozzle assembly according to claim 1, said cutting blade having an aperture formed therein; and said means to secure said cutting blade comprising: means extending into said aperture in said cutting blade and secured to said hollow tubular body to limit longitudinal movement of said cutting blade.

4. A blade holder and nozzle assembly according to claim 3, said means extending into said aperture comprising: a detent.

5. A blade holder and nozzle assembly according to claim 1, said elongated opening having a T-shaped cross-section to permit deflection of a central portion of said cutting blade.

* * * * *